US006241563B1

(12) United States Patent
Warner et al.

(10) Patent No.: US 6,241,563 B1
(45) **Date of Patent: *Jun. 5, 2001**

(54) ELECTRICAL CONNECTOR

(75) Inventors: Roy K. Warner, Lehigh Acres; Paul A. Cornell, Naples, both of FL (US)

(73) Assignee: Pan Electric Corporation, Carson City, NV (US)

( * ) Notice: Subject to any disclaimer, the term of this patent is extended or adjusted under 35 U.S.C. 154(b) by 19 days.

This patent is subject to a terminal disclaimer.

(21) Appl. No.: 09/555,833

(22) PCT Filed: Nov. 25, 1998

(86) PCT No.: PCT/US98/25280

§ 371 Date: Jun. 5, 2000

§ 102(e) Date: Jun. 5, 2000

(87) PCT Pub. No.: WO99/30386

PCT Pub. Date: Jun. 17, 1999

Related U.S. Application Data

(63) Continuation-in-part of application No. 08/985,883, filed on Dec. 5, 1997, now Pat. No. 5,919,065.

(51) Int. Cl.[7] ..... H01R 4/40
(52) U.S. Cl. ..... 439/789
(58) Field of Search ..... 439/789, 790, 439/791, 410, 806

(56) References Cited

U.S. PATENT DOCUMENTS

| | | | |
|---|---|---|---|
| D. 296,777 | 7/1988 | Cornell | D13/149 |
| 318,182 | 5/1885 | Guhl | 24/135 K |
| 879,940 | 2/1908 | Blood, Jr. | 439/806 |
| 1,679,677 | 8/1928 | Milne | 439/100 |
| 2,370,748 | 3/1945 | O'Donnell | 439/73 |
| 2,452,406 | 10/1948 | Volkery et al. | 439/391 |
| 2,700,807 | 2/1955 | Petersen | 24/115 R |
| 2,915,275 | 12/1959 | Korka | 248/327 |
| 3,019,409 | 1/1962 | Sarafinas | 439/92 |
| 3,138,422 | 6/1964 | Lawlor | 439/789 |
| 3,169,818 | 2/1965 | Tracy | 439/789 |
| 3,351,889 | 11/1967 | Lawlor et al. | 439/410 |
| 3,437,979 | 4/1969 | Beaudion | 439/432 |
| 3,537,150 | 11/1970 | Emberson | 439/344 |
| 3,801,952 | 4/1974 | Lawlor | 439/789 |

(List continued on next page.)

FOREIGN PATENT DOCUMENTS

| | | |
|---|---|---|
| 77339 | 7/1919 | (AT) . |
| 147455 | 8/1921 | (GB) . |
| 529520 | 11/1940 | (GB) . |
| 1188953 | 4/1970 | (GB) . |

OTHER PUBLICATIONS

AMP Inc., Ampact, AMP Wrench–Lok, AMP Miniwedge Connectors, 1995.

Eritech, Inc., "Ground Rod Accessories," pp. A1–9–A1–10, A2–1–A2–21 (1994).

*Primary Examiner*—Tulsidas Patel
(74) *Attorney, Agent, or Firm*—Brinks Hofer Gilson & Lione

(57) ABSTRACT

An electrical connector (10) includes inner and outer conductive straps (14, 12), each having a tail (18, 24) and a conductor-receiving portion (26, 20). The conductor-receiving portions (26, 20) are wrapped in reverse directions with respect to the axis of rotation (A) of the connector to reduce any tendency of the inner element to bind or stick in the outer element. The connector includes conductor receiving passages or openings (30, 32) for both a larger conductor such as a ground rod (C1) and a smaller conductor such as a ground wire (C2). The conductor receiving openings are oval for the ground rod and circular for the ground wire such that the connector distorts the ground wire to a greater extent than it distorts the ground rod as the connector is closed.

10 Claims, 2 Drawing Sheets

U.S. PATENT DOCUMENTS

| | | | |
|---|---|---|---|
| 3,831,134 | 8/1974 | Cornell et al. | 439/789 |
| 3,861,771 | 1/1975 | Cornell | 439/434 |
| 3,879,104 | 4/1975 | Shugarman et al. | 439/759 |
| 3,883,211 | 5/1975 | Shugarman et al. | 439/789 |
| 3,892,455 | 7/1975 | Sotolongo | 439/100 |
| 3,973,821 | 8/1976 | Scott et al. | 439/789 |
| 3,980,381 | 9/1976 | Cornell | 439/427 |
| 3,985,411 | 10/1976 | Mooney et al. | 439/791 |
| 3,990,129 | 11/1976 | Cornell et al. | 24/132 R |
| 4,001,921 | 1/1977 | Lawlor et al. | 24/132 R |
| 4,014,078 | 3/1977 | Cornell et al. | 24/132 R |
| 4,097,169 | 6/1978 | Kelly | 403/391 |
| 4,126,918 | 11/1978 | Cornell | 439/132 R |
| 4,128,294 | 12/1978 | McCord | 439/789 |
| 4,186,981 | 2/1980 | Holton | 439/92 |
| 4,357,068 | 11/1982 | Cornell et al. | 439/789 |
| 4,475,843 | 10/1984 | Wyler | 439/394 |
| 4,479,694 | 10/1984 | Cornell et al. | 439/789 |
| 4,526,428 | 7/1985 | Sachs | 439/92 |
| 4,548,462 | 10/1985 | Cornell | 439/789 |
| 4,898,551 | 2/1990 | Cornell | 439/789 |
| 5,765,962 | 6/1998 | Cornell et al. | 439/789 |

ELECTRICAL CONNECTOR

CROSS-REFERENCE TO RELATED APPLICATION

This application is a 371 of PCT/US98/25280 filed Nov. 25, 1998 and a continuation-in-part of U.S. patent application Ser. No. 08/985,883, filed Dec. 5, 1997 now U.S. Pat. No. 5,919,065 the entirety of which is hereby incorporated by reference.

BACKGROUND

This invention relates to an improved electrical connector of the type having inner and outer connector parts formed from respective conductive straps, wherein the inner connector part fits within the outer connector part and rotates between a clamped and an unclamped position.

Electrical connectors of this general type are described for example in Lawlor U.S. Pat. Nos. 3,351,889 and 3,138,422. In the connectors described in the Lawlor patents, the inner and outer connector parts include cable receiving bores that are aligned when the parts are in an unclamped position, and are misaligned when the parts are in a clamped position. This misalignment deforms the clamped cable to establish electrical and mechanical contact between the cable and the connector.

In use it is important that there be a low-resistance connection between the connector and the cable over an extended time period, in spite of thermal fluctuations and associated changes in physical dimensions. The present invention is directed to improvements to electrical connectors that are intended to provide an improved spring action to maintain a force against the cable and therefore electrical contact over an extended time period.

SUMMARY

The present invention is defined by the following claims, and nothing in this section should be taken as a limitation on those claims. By way of introduction, it can be said that the electrical connector described below includes inner and outer connector parts having connector receiving portions that are wrapped around the rotational axis of the connector in opposite directions. This arrangement insures that the clamping forces generated when the connector is closed tend to move both the inner and the outer conductor receiving portions in either a diameter-increasing or diameter-decreasing direction, depending upon the direction of closing. Because both the inner and the outer connector parts change diameter in the same sense, there is a reduced tendency for the inner connector part to bind or stick in the outer connector part. This allows clamping forces to be transmitted efficiently to the clamped conductor. Spring forces developed in the connector parts are thus available to maintain an excellent electrical connection between the connector parts and the clamped conductor.

Another aspect of the connector described below allows the connector to clamp two separate conductors of varying diameters effectively. The conductor receiving openings for the smaller conductor are generally circular while the conductor receiving openings for the larger conductor are oval in shape, elongated along the closing direction. This arrangement provides a greater amount of play between the conductor receiving portions and the larger conductor than between the conductor receiving portions and the smaller conductor. For this reason, as the inner connector part is rotated to the clamped position, the smaller conductor is distorted or bent to a greater extent than is the larger conductor. By properly selecting the degree of elongation of the oval openings for the larger conductor, the clamping force on the larger conductor can be adjusted as appropriate, while maintaining the desired clamping force on the smaller conductor.

The invention itself, together with further objects and associated advantages, will best be understood by reference to the following detailed description, taken in conjunction with the accompanying drawings.

DETAILED DESCRIPTION OF THE PRESENTLY PREFERRED EMBODIMENTS

Figure 5:
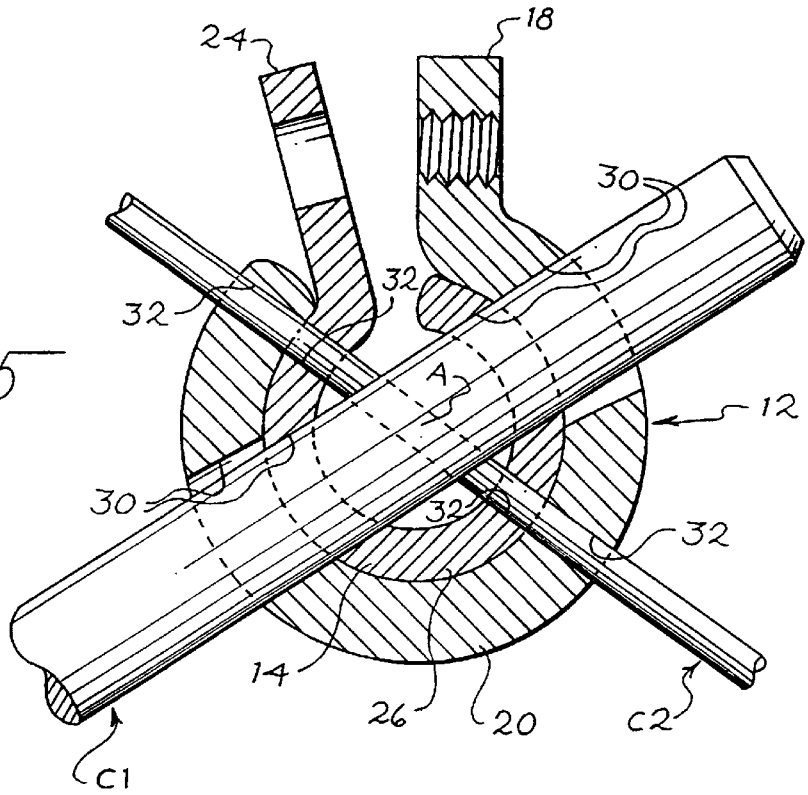
FIG. 5 is a cross-sectional view corresponding to that of FIG. 1, a showing the connector in an unclamped position.
Figure 1:
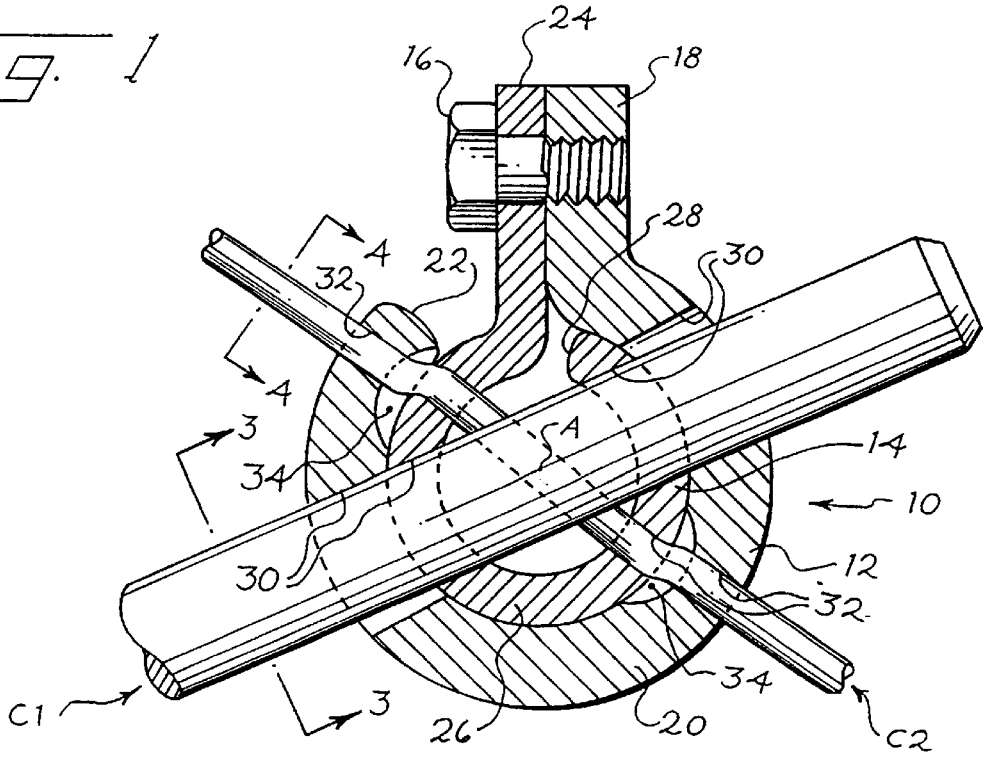
FIG. 1 is a cross-sectional view taken along line 1—1 of FIG. 2 of an electrical conductor that incorporates a presently preferred embodiment of this invention.

Turning now to the drawings, FIG. 1 shows a cross-sectional view of . an electrical connector 10 that includes a first or outer connector part 12 and a second or inner connector part 14. The inner connector part 14 is rotatable about an axis A between an undamped position, as shown in FIG. 5, and a clamped position, as shown in FIG. 1, by action of a bolt 16 that passes through the inner connector part 14 and is threaded in the outer connector part 12.

The connector parts 12, 14 in this embodiment are formed of a conductive strap of a suitable conductive metal such as an aluminum alloy. In this embodiment each of the conductive straps is substantially uniform in thickness, though this is not required for all embodiments. The conductive straps may be bent from strips of a suitable metal, or alternately they may be extruded in the shape shown.

The outer connector portion 12 includes a tail 18 that threadedly receives the bolt 16 and a conductor receiving portion 20 that is generally C-shaped. As shown in FIG. 1, the conductor receiving portion 20 is wrapped in a clockwise direction about the axis A as you proceed from the tail 18 to the free end 22.

The inner connector part 14 includes a tail 24 that freely receives the bolt 16 and a conductor receiving portion 26 that is received within the outer conductor receiving portion 20. As shown in FIG. 1, the inner conductor receiving portion 26 is wrapped in a counter-clockwise direction about the axis A as you proceed from the tail 24 to the free end 28. Thus, the inner and outer conductor receiving portions 26, 20 are wrapped in opposite directions about the axis A.

Figure 2:
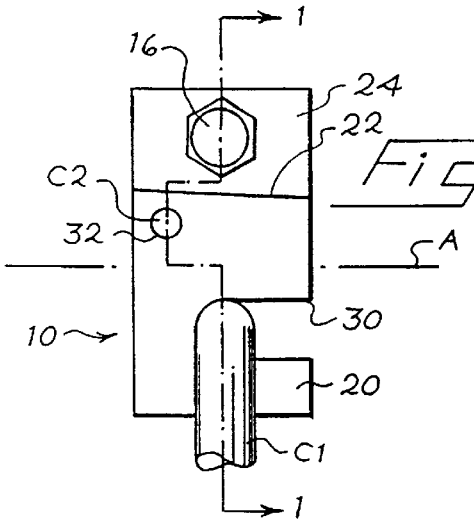
FIG. 2 is a side-view of the connector of FIG. 1.
Figure 3:
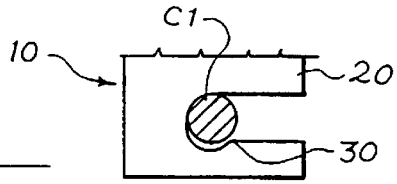
FIG. 3 is a sectional view taken along line 3—3 of FIG. 1.
Figure 4:
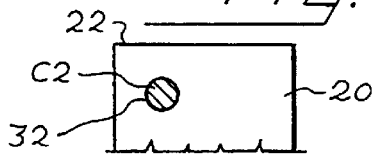
FIG. 4 is a sectional view taken along line 4—4 of FIG. 1.

The conductor receiving portions 20, 26 define first and second sets of conductor receiving openings 30, 32, respectively. The first conductor receiving openings 30 are adapted for use with a larger conductor C1, and the second conductor receiving opening 32 are adapted for use with a smaller conductor C2. As best shown in FIG. 2, the first, or larger conductor receiving openings 30 are larger parallel to the axis A than are the second, smaller conductor receiving openings 32. As shown in FIGS. 3 and 4, the larger conductor receiving openings 30 of the outer conductor receiving portion 20 are oval in shape, while the smaller conductor receiving openings 32 are circular in shape. Thus, the larger conductor receiving openings 30 are more elongated along a direction perpendicular to the axis A than are the smaller conductor receiving openings 32.

As best shown in FIG. 1, recesses 34 are preferably formed in one or both of the conductor receiving portions 26, 30 between the conductor receiving portions 26, 30 adjacent to the smaller conductor receiving openings 32. If desired, similar recesses (not shown) can be provided adjacent to the larger conductor receiving openings 30, though in many cases this will not be required.

In this embodiment, the larger conductor receiving openings 30 are formed as slots that extend to one side of the connector 10, as shown in FIGS. 2 and 3. This construction allows the larger conductor C1 to be inserted into the openings 30 either axially, along the length of the conductor C1, or laterally, from the right side of the connector 10 as shown in FIG. 2. Lateral insertion can be advantageous, for example in the situation where the conductor C1 is a ground rod and the head of the ground rod has been enlarged by hammer blows to the point above the head cannot pass through the openings 30 axially. Though not shown in FIG. 2, the smaller conductor receiving openings 32 may also be formed as slots that extend to one side of the connector 10.

In use, the connector 10 is positioned in an unclamped position by rotating the inner connector part 14 with respect to the outer connector part 12 about the axis A to the position shown in FIG. 5. In this position, the first conductor receiving openings 30 are aligned with one another, as are the second conductor receiving openings. The larger conductor C1 can then be placed in the conductor receiving openings 30 and the smaller conductor C2 can be placed in the conductor receiving openings 32 without deforming either of the conductors C1, C2.

In order to close the electrical connector 10 on the conductors C1, C2, the bolt 16 is engaged with the outer tail 18, and a wrench (not shown) is used to tighten the bolt 16 and to rotate the inner connector part 14 about the as A with respect to the outer connector part 12 to the clamped position shown in FIG. 1. This rotation misaligns the conductor receiving openings 30, 32 in the conductor receiving portions 26, 30. It should be noted that because the smaller conductor C2 is received in the conductor receiving openings 32 with less play in the closing direction than is the larger conductor C1, the initial closing movement of the inner connector part 14 begins to deform the smaller conductor C2 before any clamping forces are applied to the larger conductor C1. This is due to the oval shape of the larger conductor receiving openings 30. After the inner connector part 14 has been moved a portion of the distance to the clamping position of FIG. 1, clamping forces begin to be applied to the larger conductor C1. The recesses 34 provide room for the smaller conductor C2 to bend, thereby reducing shearing forces that would tend to cut or part the smaller conductor C2.

Because the conductor receiving portions 20, 26 are wound in reverse directions, the arrangement shown in FIG. 1 tends to reduce binding or sticking between the conductor receiving portions 20, 26. In particular, forces exerted by the conductors C1, C2 on the outer conductor receiving portion 20 tend to wind the outer conductor receiving portion 20 more tightly about the axis A and to reduce its diameter. Similarly, forces exerted by the conductors C1, C2 on the inner conductor receiving portion 26 tend to wind the inner conductor receiving portion 26 more tightly about the axis A, and to reduce its diameter as well. Since both of the conductor receiving portions 20, 26 tend to smaller diameter as the connector 10 is clamped, there is a reduced tendency for the inner conductor receiving portion 26 to bind or stick in the outer conductor receiving portion 20.

For these reasons, spring forces developed in the tails 18, 24 are transmitted efficiently to the conductors C1, C2. In this way the electrical connector 10 provides an effective spring action in use that maintains a low resistance connection with the conductors Cl, C2 in spite of thermal expansion and contraction. This arrangement is quite different from that of the Lawlor patents described above, in which the inner and outer conductor receiving portions are wrapped in the same direction about the rotational axis. In the designs illustrated in the Lawlor patents the inner conductor receiving portion tends to be unwrapped or expanded in diameter while the outer conductor receiving portion tends to be more tightly wrapped or reduced in diameter as the connector is closed. This arrangement has a greater tendency to create binding or sticking forces between the inner and outer connector parts.

Of course, many alternatives are possible to the preferred embodiment described above. For example, the connector of this invention can be adapted for use with a single conductor, two conductors, or more than two conductors. The two conductor embodiment described above is particularly useful as a grounding rod connector, because the larger conductor C1 can be a grounding rod and the smaller conductor C2 can be a grounding wire.

Figure 6:
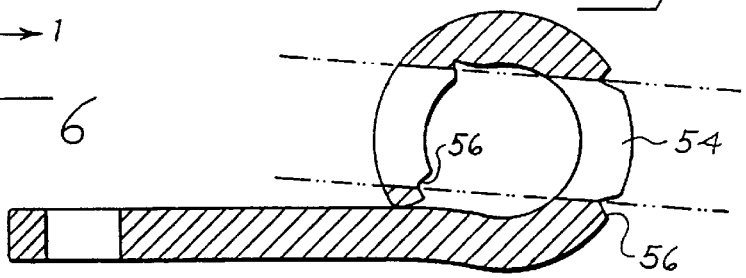
FIGS. 6, 7 and 8 are side views of inner, an inner connector part, an outer connector part, and an assembled connector of a second preferred embodiment.
Figure 7:
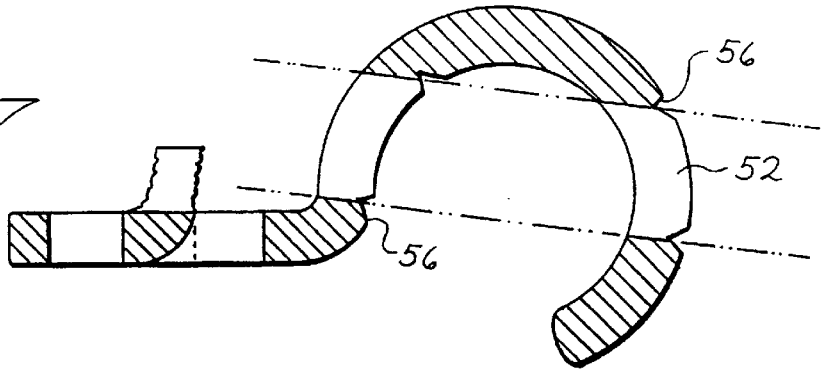
Figure 8:
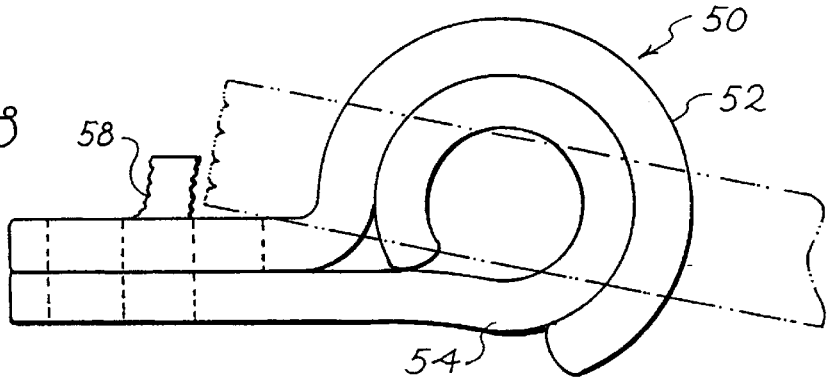

One alternative embodiment is shown in FIGS. 6, 7 and 8. FIG. 6 shows an inner connector part 54, FIG. 7 shows an outer connector part 52, and FIG. 8 shows an electroconnector 50 that is assembled from the inner and outer connector parts 54, 52. The electrical connector 50 is quite similar to the electrical connector 10 described above and operates in substantially the same way. Three principal differences include the fact that the connector 50 is formed as a terminal and is adapted to connect to only a single conductor. A second difference relates to chamfers 56 which are formed on the lead-in surfaces of the bores in the outer and inner connector parts 52, 54. These chamfers facilitate insertion of a fine stranded cable into the electroconnector 50 by providing funnel-shaped lead-in surfaces. As a third difference, the outer connector part 52 includes a cable stop 58 that is pressed out of the body of the outer connector part 52. As shown in FIG. 8, the cable stop 58 limits the maximum insertion depth of the cable being terminated.

In another alternative (not shown) the cable receiving openings in the inner and outer connector parts 54, 52 can be formed by a piercing operation that produces as a by-product the funnel-shaped cable guiding surface similar to that provided by the chamfers discussed above.

When the connector is designed for use with two conductors, they do not have to be of different sizes. Some embodiments of this invention provide openings adapted for two conductors of the same size.

The conductor-receiving openings 30, 32 may be arranged parallel to one another such that the conductors C1, C2 are generally parallel when the connector is closed. This arrangement may be preferred when the layer conductor C1 is a ground rod.

The bolt 16 can be elongated to affix the connector to a mounting surface. When this is done the bolt preferably passes freely through both of the tails.

If desired, the inner connector part 14 can be made symmetrical with respect to a plane of symmetry, and it can include a skewed bore. In this way, the advantages of a reversible inner connector element can be obtained, as described for example in U.S. Pat. No. 4,479,694, assigned to the assignee of the present invention.

When oval openings are used, it is not required that all four of the openings be oval in shape. Rather, some of the openings may be circular and others may be oval, as long as the play described above is provided. The desired play can be provided with circular openings for both conductors C1, C2, by properly selecting the sizes of the openings to provide more play for the conductor Cl than the conductor C2.

In yet other alternatives the conductors do not extend completely through the connector, and each set of conductor receiving openings includes only two openings, one in each of the inner and outer conductor receiving portions.

Furthermore, the various improvements included in the connector 10 can be used separately from one another, rather than in combination as described above. For example, a connector with reversely wound conductor receiving portions can be used with circular rather than oval openings. Conversely, oval openings can be used in a connector having a solid rather than a wrapped conductor receiving portion for the inner connector element.

The foregoing detailed description has discussed only a few of the many forms that the present invention can take. For this reason, it is intended that this description and the attached drawings be considered only as an illustration, and not as a definition of the invention. It is only the following claims, including all equivalents, that are intended to define the scope of this invention.

What is claimed is:

1. An electrical connector comprising:

a first connector part comprising a first conductor-receiving portion and a first tail, said first conductor-receiving portion wrapped around an axis In a first direction;

a second connector part comprising a second conductor-receiving portion and a second tail, said second conductor-receiving portion wrapped around the axis in a second direction, opposite the first direction;

said first conductor-receiving portion receiving said second conductor-receiving portion such that the second connector part is rotatable about the axis with respect to the first connector part between unclamped and clamped positions;

said conductor-receiving portions comprising a first set of conductor-receiving openings, said conductor-receiving openings misaligned to a greater extent when the first connector part is in the damped position than the unclamped position.

2. An electrical connector comprising:

a first connector part comprising a first conductor-receiving portion and a first tail, said first conductor-receiving portion wrapped around an axis in a first direction;

a second connector part comprising a second conductor-receiving portion and a second tail, said second conductor-receiving portion wrapped around the axis in a second direction, opposite the first direction;

said first conductor-receiving portion receiving said second conductor-receiving portion such that the second connector part is rotatable about the axis with respect to the first connector part between unclamped and clamped positions;

said conductor-receiving portions comprising a first set of conductor-receiving openings, said conductor-receiving openings misaligned to a greater extent when the first connector part is in the clamped position than the unclamped position;

wherein at least some of the conductor-receiving openings are chamfered to facilitate conductor insertion.

3. An electrical connector comprising:

a first connector part comprising a first conductor-receiving portion and a first tail, said first conductor-receiving portion wrapped around an axis in a first direction;

a second connector part comprising a second conductor-receiving portion and a second tail, said second conductor-receiving portion wrapped around the axis in a second direction, opposite the first direction;

said first conductor-receiving portion receiving said second conductor-receiving portion such that the second connector art is rotatable about the axis with respect to the first connector part between unclamped and clamped positions;

said conductor-receiving portions comprising a first set of conductor-receiving openings, said conductor-receiving openings misaligned to a greater extent when the first connector part is in the clamped position than the unclamped position; and a stop formed in the first tail to limit insertion depth of a conductor.

4. The invention of claim 1, 2 or 3 wherein the first and second conductor-receiving portions further comprise a set of second conductor-receiving openings, said second conductor-receiving openings differing in size from the first conductor-receiving openings.

5. The invention of claim 4 wherein the first conductor-receiving openings are larger than the second conductor-receiving openings parallel to the axis, and wherein the first conductor-receiving openings are more elongated along a direction substantially transverse to the axis than the second conductor-receiving openings.

6. The invention of claim 1, 2 or 3 wherein the first and second connector parts are each substantially uniform in thickness.

7. The invention of claim 1, 2 or 3 wherein the second connector part rotates in the first direction with respect to the first connector part as the second connector part moves between the unclamped and clamped positions.

8. The invention of claim 1, 2 or 3 wherein the first set of conductor-receiving openings extends to a side of the conductor-receiving portions to laterally receive a conductor.

9. The invention of claim 1 wherein at least some of the conductor-receiving openings are chamfered to facilitate conductor insertion.

10. The invention of claim 1 further comprising a stop formed in the first tail to limit insertion depth of a conductor.

* * * * *

UNITED STATES PATENT AND TRADEMARK OFFICE

CERTIFICATE OF CORRECTION

PATENT NO. : 6,241,563 B1
DATED : June 5, 2001
INVENTOR(S) : Roy K. Warner et al.

It is certified that error appears in the above-identified patent and that said Letters Patent is hereby corrected as shown below:

Column 5,
Line 39, delete "In" and substitute -- in -- in its place.
Line 54, delete "damped" and substitute -- clamped -- in its place.

Column 6,
Line 25, delete "art" and substitute -- part -- in its place.
Lines 61-62, delete "The invention of claim 1 further comprising a stop formed in the first tail to limit insertion depth of a conductor." and insert the following:
-- An electrical connector comprising:

a first connector part comprising a first conductive strap comprising a first conductor-receiving portion and a first tail, said first conductor-receiving portion wrapped around an axis in a first direction;

a second connector part comprising a second conductive strap comprising a second conductor-receiving portion and a second tail, said second conductor-receiving portion wrapped around the axis in a second direction, opposite the first direction;

said first conductor-receiving portion receiving said second conductor-receiving portion such that the second connector portion is rotatable about the axis with respect to the first connector portion between unclamped and clamped positions;

said conductor-receiving portions comprising a first set of conductor-receiving openings, said conductor-receiving openings misaligned to a greater extent when the first connector portion is in the clamped position than the unclamped position;

a stop formed in the first tail to limit insertion depth of a conductor. --

Signed and Sealed this

Seventh Day of May, 2002

*Attest:*

*Attesting Officer*

JAMES E. ROGAN
*Director of the United States Patent and Trademark Office*